US008555511B2

(12) United States Patent
Moseman

(10) Patent No.: US 8,555,511 B2
(45) Date of Patent: Oct. 15, 2013

(54) MOVABLE LUBRICATING WICK FOR HAIR CLIPPER

(75) Inventor: Russell L. Moseman, Sterling, IL (US)

(73) Assignee: WAHL Clipper Corporation, Sterling, IL (US)

( * ) Notice: Subject to any disclaimer, the term of this patent is extended or adjusted under 35 U.S.C. 154(b) by 762 days.

(21) Appl. No.: 12/727,813

(22) Filed: Mar. 19, 2010

(65) Prior Publication Data

US 2011/0225827 A1 Sep. 22, 2011

(51) Int. Cl.
*B26B 19/06* (2006.01)

(52) U.S. Cl.
USPC ..... 30/210; 30/216; 30/45

(58) Field of Classification Search
USPC ..... 30/41, 43–46, 50, 32, 23.3, 123.3, 228, 30/92, 93–95, 43.41, 43.4, 210, 209, 216, 30/215, 433.92
See application file for complete search history.

(56) References Cited

U.S. PATENT DOCUMENTS 1,357,364 A * 11/1920 Van Bree ..... 30/221
1,835,613 A * 12/1931 Perlman ..... 7/158
2,194,465 A * 3/1940 Bott ..... 30/43
2,221,639 A * 11/1940 Johnson et al. ..... 310/47
2,225,581 A * 12/1940 Berg ..... 30/43.2
2,628,871 A 2/1953 Powers
3,119,461 A 1/1964 Enders
3,119,942 A * 1/1964 Luther ..... 173/171
3,146,856 A 9/1964 Enders
3,206,850 A * 9/1965 Jepson ..... 30/43.9
3,244,916 A * 4/1966 Jepson ..... 310/80
3,290,776 A * 12/1966 Jepson et al. ..... 30/43.9
3,336,092 A 8/1967 Dochterman
3,550,280 A * 12/1970 Bernhard ..... 30/217
4,008,788 A 2/1977 Whitt
4,486,951 A * 12/1984 Leibowitz ..... 30/45
4,781,476 A * 11/1988 Uhen ..... 384/136
5,379,856 A 1/1995 Blee
5,384,961 A 1/1995 Gregory
2007/0044604 A1 * 3/2007 Andis et al. ..... 83/13

* cited by examiner

*Primary Examiner* — Andrea L Wellington
*Assistant Examiner* — Fernando Ayala
(74) *Attorney, Agent, or Firm* — Greer, Burns & Crain, Ltd.

(57) ABSTRACT

A lubricated hair clipper drive system includes a clipper frame with a pair of opposed arms separated by a drive space, a drive shaft reciprocating laterally between the arms at high speed, a drive member receiving motive power from a power source and secured to the shaft for common reciprocation within the drive space, and a lubricant reservoir and applicator disposed on the shaft between the drive member and a corresponding one of the arms.

11 Claims, 5 Drawing Sheets

MOVABLE LUBRICATING WICK FOR HAIR CLIPPER

BACKGROUND

The present invention relates generally to hair cutting devices having a bladeset including a moving blade reciprocating relative to a stationary blade and a drive system for powering the bladeset, and more specifically to a lubrication system for hair clippers or trimmers used for cutting hair of humans or animals.

Conventional hair cutting devices using a rotary drive system, such as hair trimmers and clippers typically include a drive member powered by the output shaft of the motor. For the purposes of this application, the terms "hair cutting device", "hair clipper" and "hair trimmer" are considered interchangeable. The drive system converts rotary motion generated by the motor into linear motion in the form of the reciprocating moving blade relative to the stationary blade.

In a hair clipper drive system disclosed in U.S. Pat. No. 7,346,990 incorporated by reference herein, a driving end of the drive member follows a linearly reciprocating path as it engages the moving blade of the bladeset. In a production version of the invention disclosed in the '990 patent, the drive member is secured to a transverse shaft, also referred to as a linear drive shaft, which reciprocates with the drive member relative to the clipper frame. In some applications, over time, there has been excessive friction between the shaft and sleeve bushings mounted in the clipper frame. As a result, operational conditions, including heat and friction, combine to cause wear and deterioration of the sleeve bushings through which the linear drive shaft slides. Such wear decreases operational efficiency of the clipper and often increases operational noise.

Insufficient lubrication limits the ability to overcome what is known as "stiction." Stiction is an informal combination of the term "static friction," perhaps also influenced by the verb "stick." Two solid objects, such as the linear drive shaft and a sleeve bushing, pressing against each other (but not sliding) will require some threshold of force parallel to the surface of contact to overcome static cohesion. Stiction is that threshold (not a continuous force) encountered during each cycle of the linear drive shaft when it changes direction. For a brief moment, the drive is stationary, and a "running oil film" that the sleeve bushings rely on for their service life is diminished. To obtain an extended life expectancy for the sleeve bushings on the linear drive shaft, a lubricant film should be reestablished once the drive shaft begins to move again.

Thus, there is a need for a lubrication system for a hair cutting device which addresses the above-identified problems of conventional units.

SUMMARY

The above-listed need is met or exceeded by the present hair cutting device which overcomes the limitations of the current technology. Among other things, the present cutting device is designed for accommodating reciprocating linear movement of a drive member attached to a linear drive shaft. To improve the lubrication of the reciprocating shaft relative to the clipper frame, the linear drive shaft is provided with movable lubricant applicators in the form of foam wicks sandwiched between the drive member and the respective clipper frame arm as the drive shaft slides through sleeve bushings attached to each clipper frame arm.

In contrast to conventional wicking materials and methods, the present system provides for reestablishment of a lubricant film after each cycle of the linear drive shaft. In this application, the lubricant applicators are soaked in oil and the volume of oil the foam wicks hold is based on their expanded size. As the drive member cycles toward one arm, the applicator is placed into compression between the drive member and that arm, releasing the lubricating oil 360 degrees around the linear drive shaft, thus substantially coating the shaft. As the drive member cycles away from the wick, the wick expands only partially, as the preferred type of foam is one that slowly rebounds. However, the amount that the applicator is cyclically compressed produces a pumping type action that allows this slow rebounding material to maintain a greater amount of oil upon the shaft and bushings for better performance and longer life by reabsorbing the excess oil. Once the clipper is turned off, the wicks absorb excess oil from the shaft, and act as a reservoir.

An advantage of the foam lubricant applicator over conventional wicking materials of cotton and felt is that the vast majority of the foam's volume is made up of air. This air, when displaced by lubricant, allows the foam wick to carry as much as four times the volume of lubricant over its conventional counterparts.

More specifically, the present lubricated hair clipper drive system includes a clipper frame with a pair of opposed arms separated by a drive space, a drive shaft reciprocating laterally between the arms at high speed, a drive member receiving motive power from a power source and secured to the shaft for common reciprocation within the drive space, and a lubricant reservoir and applicator disposed on the shaft between the drive member and a corresponding one of the arms.

DETAILED DESCRIPTION

Figure 1:
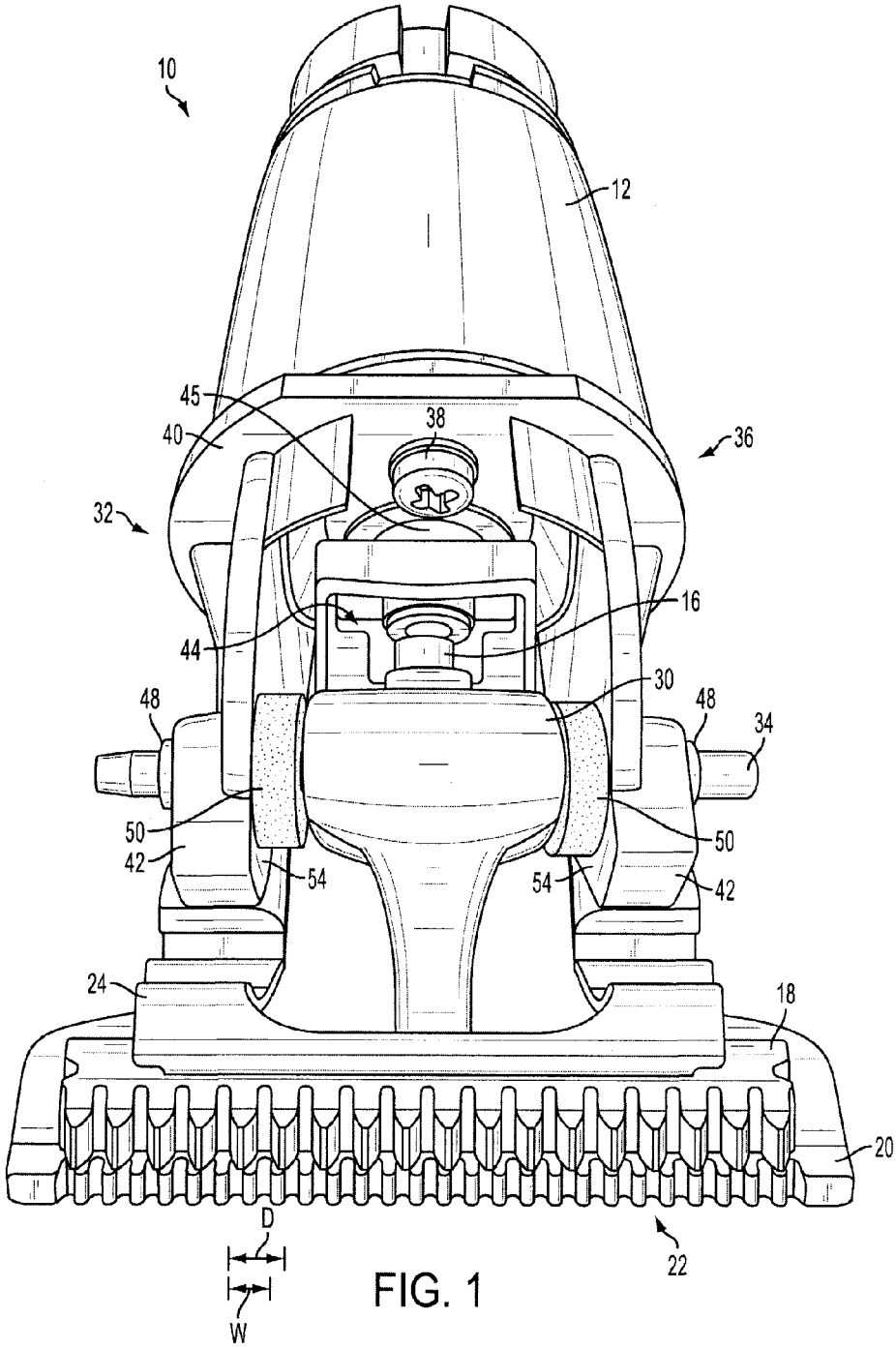
FIG. 1 is a fragmentary top perspective view of a hair clipper provided with the present hair clipper drive system.
Figure 2:
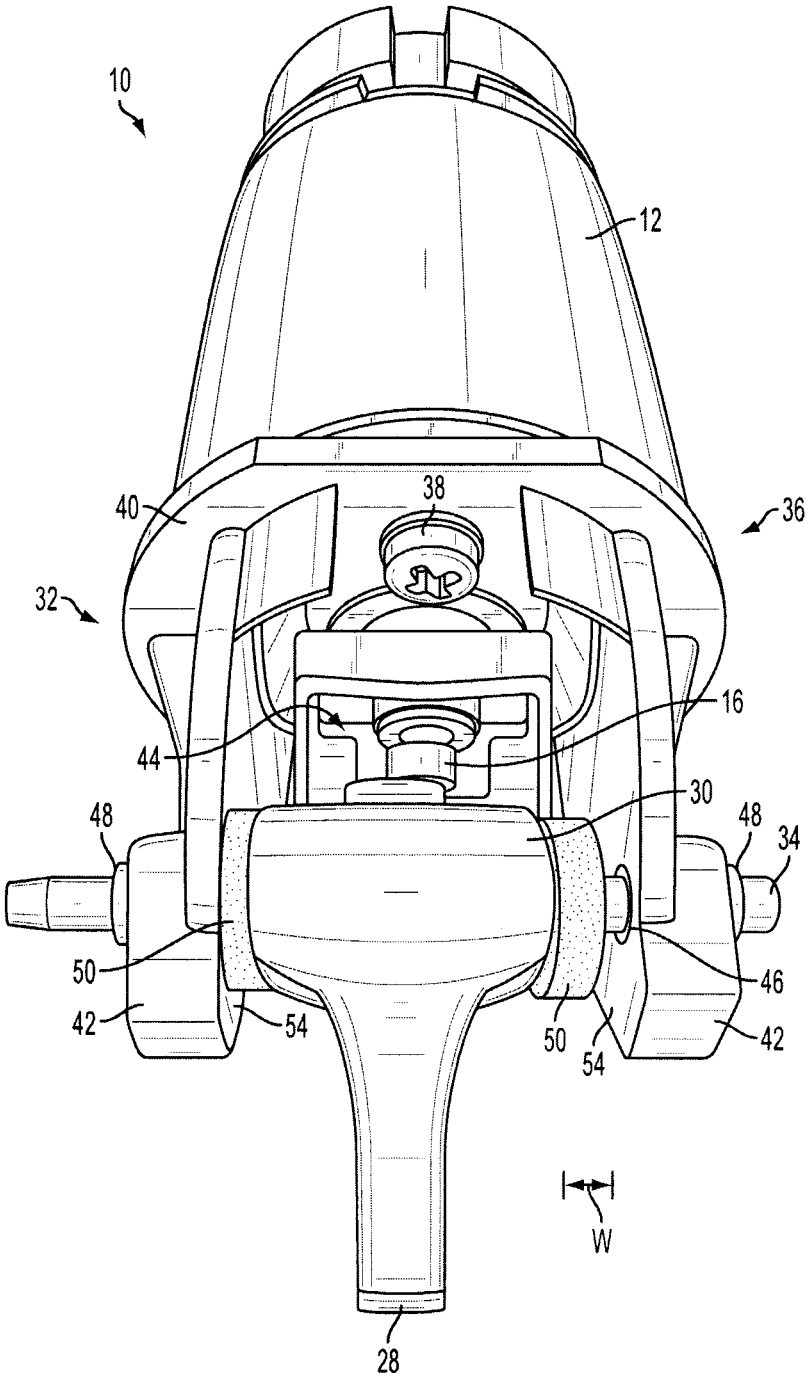
FIG. 2 is a fragmentary perspective sequential view of the present drive system in motion just after start up.

Referring to FIGS. 1 and 2, a hair clipper suitable for use with the present drive system is generally designated 10, and includes a motor 12, typically an electric motor powered by battery or line voltage. As is well known in the art, the clipper 10 is provided with a covering housing, not shown here. It will be appreciated that the size and/or type of the motor 12 may vary to suit the application. The motor 12 is designated as a rotary type, having an axially projecting output shaft (not shown) connected to an off-center cam 16. As is well known in the art, rotation of the output shaft is translated into reciprocating linear motion of a moving blade 18 relative to a stationary blade 20 of a clipper bladeset 22.

The bladeset 22 typically includes a biasing element 24 in the form of a spring which causes the moving blade 18 to be slidingly biased against the stationary blade 20 for more effective cutting action. In the present embodiment, the moving blade 18 defines a drive recess (not shown) for receiving a blade engagement or driving tip 28 (FIG. 2) of a driving member 30. A drive system, generally designated 32, receives power from the motor 12 and reciprocates the driving member 30, secured to a linear drive shaft 34, in a true linear fashion relative to the bladeset 22. While the drive shaft 34 is preferably unitary, multiple component shafts are also contemplated, each separately secured to a corresponding side of the driving member 30. The reciprocating movement of the driving member 30 and the drive shaft 34 is parallel to the movement of the moving blade 18. Additional details of the drive system 32 are described in U.S. Pat. No. 7,346,990, incorporated by reference herein.

Figure 3:
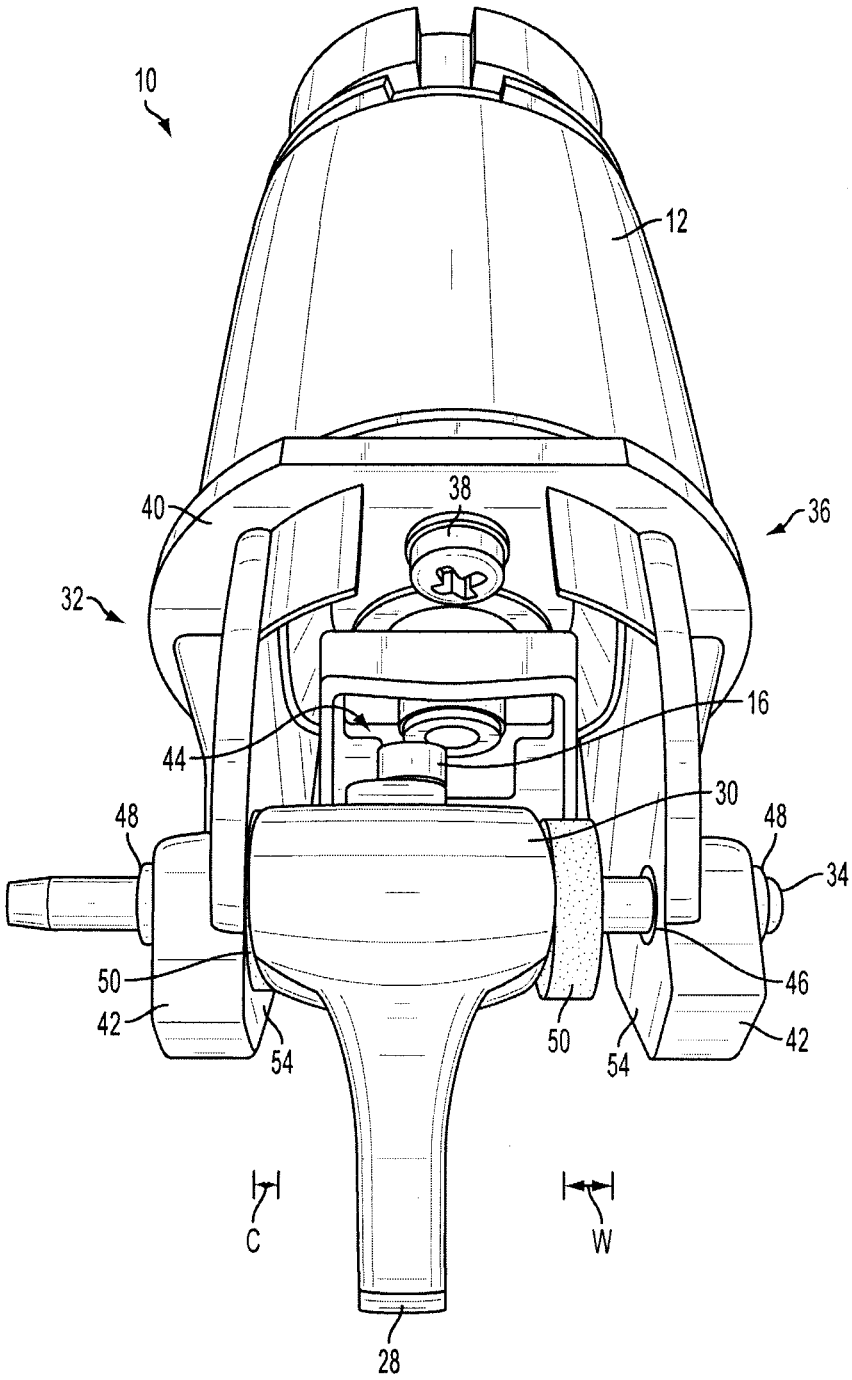
FIG. 3 is a fragmentary perspective sequential view of the present drive system after the view shown in FIG. 2.

Referring now to FIGS. 1-3, the drive system 32 includes a frame 36 mounted to the motor 12, as by suitable fasteners 38 passing through a base plate 40. The frame 36 also includes a pair of spaced, generally parallel, normally projecting arms 42. A drive space 44 is defined between the arms 42. The frame 36 is preferably unitary, however multi-component frames are also contemplated. A central opening 45 in the base plate 40 accommodates passage of the output shaft (not shown) attached to the off-center cam 16.

Each of the arms 42 has a throughbore 46 (FIGS. 2 and 3) dimensioned for accommodating the sliding linear drive shaft 34. Each throughbore 46 (FIGS. 2 and 3) is provided with a sleeve bushing 48, preferably made of relatively low friction, wear-resistant material such as brass, bronze, Delrin® material, or the like. An inner diameter of each sleeve bushing 48 is dimensioned to slidingly receive the linear drive shaft 34, and is slidingly received in the throughbores 46 on an outer diameter.

Referring to the above-identified problem of lubricating the reciprocating linear drive shaft, conventional hair clippers, as well as the present clipper 10, operate at at least approximately 1,000 RPM, generally in the range of 3,000 to 5,000 RPM and in some cases approaching 15,000 RPM. As such, maintaining proper lubrication of the linear drive shaft 34 is an operational challenge. Traditional wicking may provide some relief to this problem, but traditional materials such as cotton or felt are indiscriminate in the application of the lubricant film. Additionally, conventional wicking has a latent tendency for the lubricant to pool at the bottom of the wick and thus is insufficiently distributed on the linear drive shaft 34, further contributing to the loss of a lubricant film when the shaft changes direction. In the hair clipper 10, the lubricant film needs to be reestablished on the drive shaft 34 each time the drive shaft changes direction to reduce the negative forces due to "stiction."

Figure 5:
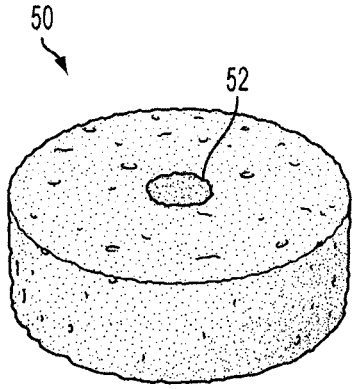
FIG. 5 is a top perspective view of the present lubricant applicator.

Referring now to FIGS. 1, 2 and 5, an important feature of the present clipper drive system 32 is the provision of a lubricant wick applicator, generally designated 50, which is soaked in oil (not shown), though other lubricants have been contemplated, and is disposed on the drive shaft 34. In the instant application, the applicator 50 is designed to be slidable relative to the drive shaft 34. While captured between the drive member 30 and the frame arms 42, the applicator 50 is otherwise freely movable upon the drive shaft 34. In the preferred embodiment, an applicator 50 is disposed on each side of the drive member 30, although the number of applicators may vary to suit the situation. It is also preferred that each applicator 50 is uncovered to allow for efficient lubrication of the drive shaft 34. Furthermore, although other materials are useable, in the present application the applicator 50 is made of open-celled foam (FIG. 5) and is shaped as a cylindrical disk, however other shapes are contemplated depending on the application. A central throughbore 52 is provided for slidingly accommodating the drive shaft 34.

Referring now to FIGS. 1 and 3, each applicator 50 has an axial width 'W' in the uncompressed start up condition where the drive member 30 is in a mid-arm position, and a compressed width 'C' in an operational condition. It will be understood that in many cases, the hair clipper 10 will not start with the drive member 30 in the mid-arm position of FIG. 1. In contrast, the drive member 30 will be located in whatever position it was when the clipper was last turned off. Additionally, in the mid-arm position seen in FIG. 1, the width 'W' of the applicator 50 preferably extends more than half a distance 'D' on the drive shaft 34 between the drive member 30 and a corresponding inner surface 54 of the arm 42.

Referring now to FIG. 2, the drive system 32 enters an operational condition upon turning on of the motor 12, wherein the drive shaft 34, oriented parallel to the operational axis of the moving blade 18, reciprocates laterally relative to the arms 42 at a high speed, typically at least 1,000 RPM and in some cases approaching 15,000 RPM. Through operation of the drive member 30, the applicator 50 is compressed against the corresponding arm 42, releasing lubricant onto the drive shaft 34, preferably around a full periphery of the shaft, approximately 360 degrees around. Thus, the applicator facilitates sliding of the drive shaft relative to the arm, and more specifically through the sleeve bushings 48.

Figure 4:
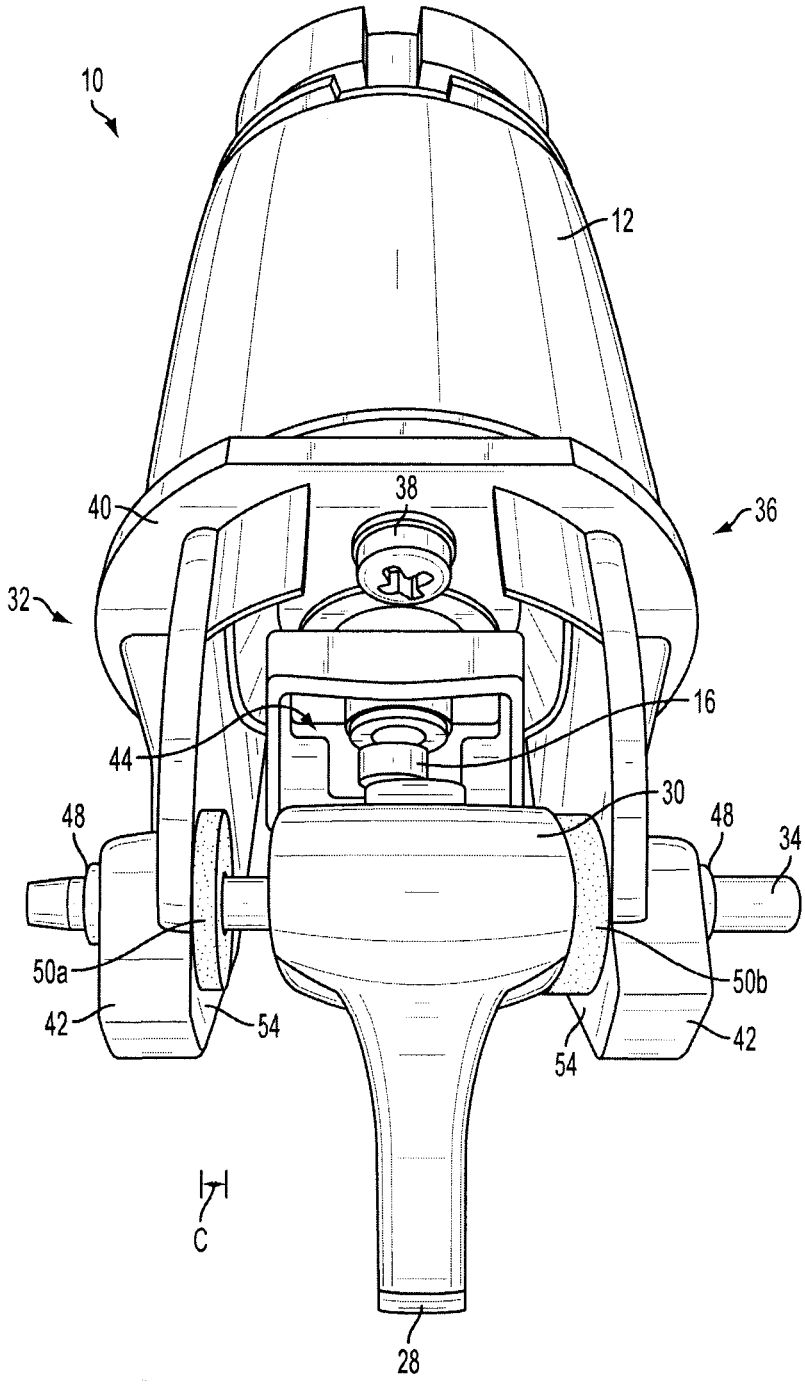
FIG. 4 is a fragmentary perspective sequential view of the present drive system after the view shown in FIG. 3.

Referring now to FIG. 4, as mentioned above, during clipper operation, the left applicator 50*a* is compressed against the inner surface of the corresponding arm 42 through the reciprocal movement of the drive shaft 34 and the drive member 30. As a result, the compressed applicator 50*a* is temporarily adhered to the corresponding arm 42 when the hair clipper drive system 32 is in the fully operational condition. Due to the slow rebounding properties of the foam applicator 50, it will remain compressed as the drive member 30 cycles to the opposite arm 42 and back to the corresponding arm. As seen in FIG. 4, the drive member 30 continues its operational cycle and proceeds to compress the opposite applicator 50*b* against the corresponding frame arm 42. While fully compressed, the width 'C' of the applicator 50 is approximately ½ of the axial width 'W'.

Also, when the clipper drive system 32 is operational, the compressed applicator 50 pumps lubricant to the drive shaft 34. An important advantage of the present applicator 50 is that its free movement along the drive shaft 34 between the drive member 30 and the corresponding frame arm 42, as well as the above-described pumping action, helps to maintain a hydrodynamic state between the drive shaft 34 and the bushing 48. Thus, the reciprocating drive shaft 34 is constantly lubricated during operation of the clipper 10.

However, once the clipper is shut down, the drive member 30 is typically in a position where pressure is released on one of the applicators 50. The decompressed applicator 50 then reverts to a rest condition and absorbs lubricant from the drive shaft 34 as it returns from its compressed width 'C' to its axial width 'W'. In this fashion, the applicator 50 also operates as a reservoir, holding the lubricant until the hair clipper 10 is switched back to the operational state.

The present application provides a drive system 32 with lubricant applicators 50 that substantially lubricate the linear drive shaft 34 and sleeve bushings 48 with a pumping action while compressed to the corresponding arm 42 when the hair clipper 10 is under operation. When the hair clipper 10 is turned off, the applicators 50 become reservoirs, storing the lubricant until the hair clipper is used again.

While a particular embodiment of the present movable lubricating wick for a hair clipper has been described herein, it will be appreciated by those skilled in the art that changes and modifications may be made thereto without departing from the invention in its broader aspects and as set forth in the following claims.

What is claimed:

1. A lubricated hair clipper drive system, comprising:

a clipper frame having a pair of opposed arms defining a drive space therebetween;

a drive shaft reciprocating laterally relative to said arms at high speed;

a drive member receiving motive power from a power source and secured to said shaft for common reciprocation in said drive space;

a lubricant applicator disposed on said shaft between said drive member and a corresponding one of said arms; and wherein said applicator is constructed and arranged to frictionally engage and be movable with said shaft when said hair clipper is in a start up condition, and through operation of said drive member, is compressed against said corresponding arm when said hair clipper is in a fully operational condition, allowing relative sliding of said shaft relative to said applicator.

2. The drive system of claim 1 wherein said applicator is temporarily adhered to said corresponding arm when said hair clipper is in said fully operational condition.

3. The drive system of claim 1 wherein said applicator is constructed and arranged have an axial width W in said start up condition, and a compressed width in said operational condition, wherein said compressed width is approximately ½ said axial width.

4. A lubricated hair clipper drive system, comprising:

a clipper frame having a pair of opposed arms defining a drive space therebetween;

a drive shaft reciprocating laterally relative to said arms at high speed;

a drive member receiving motive power from a power source and secured to said shaft for common reciprocation in said drive space;

a lubricant applicator disposed on said shaft between said drive member and a corresponding one of said arms; and wherein said applicator is constructed and arranged to have an axial width W in a start up condition with said drive member in a mid-arm position, said width extending more than half a distance on said drive shaft between said drive member and an inner surface of said arm, and said applicator is constructed and arranged to be compressed against an inner surface of said corresponding arm through reciprocal movement of said drive shaft and said drive member and having a compressed width which is less than said axial width.

5. The drive system of claim 4 wherein said compressed width is approximately ½ said axial width.

6. The drive system of claim 1, including two of said lubricant applicators, one on each side of said drive member and associated with a corresponding one of said arms.

7. A lubricated hair clipper drive system, comprising:

a clipper frame having a pair of opposed arms defining a drive space therebetween;

a drive shaft reciprocating laterally relative to said arms at high speed;

a drive member receiving motive power from a power source and secured to said shaft for common reciprocation in said drive space;

a lubricant applicator disposed on said shaft between said drive member and a corresponding one of said arms, and wherein said applicator is constructed and arranged so that upon said clipper reaching an operational condition, the applicator is compressed and pumps lubricant to said shaft, and upon said clipper being turned off and said drive member moving to a position releasing pressure on said applicator, said applicator reverts to a rest condition and absorbs lubricant from said shaft.

8. The drive system of claim 1 wherein said clipper operates at a speed of at least 1,000 RPM.

9. The drive system of claim 1 wherein said applicator applies lubricant to said shaft with each reciprocal stroke.

10. The drive system of claim 1, wherein said applicator is uncovered on said shaft.

11. The drive system of claim 1, wherein said applicator is freely slidable along said shaft between said arms.

* * * * *